US010570763B2

(12) United States Patent
Himes

(10) Patent No.: US 10,570,763 B2
(45) Date of Patent: Feb. 25, 2020

(54) GAS TURBINE ENGINE SEAL INSTALLATION PROTECTION

(71) Applicant: United Technologies Corporation, Hartford, CT (US)

(72) Inventor: Jason D. Himes, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1013 days.

(21) Appl. No.: 14/745,593

(22) Filed: Jun. 22, 2015

(65) Prior Publication Data

US 2016/0369642 A1 Dec. 22, 2016

(51) Int. Cl.
*F01D 11/00* (2006.01)

(52) U.S. Cl.
CPC ..... *F01D 11/003* (2013.01); *F01D 11/001* (2013.01); *F05D 2220/32* (2013.01); *F05D 2300/43* (2013.01)

(58) Field of Classification Search
CPC .. F01D 11/003; F01D 11/001; F05D 2220/23; F05D 2300/43
USPC ..... 277/345
See application file for complete search history.

(56) References Cited

U.S. PATENT DOCUMENTS

| | | | | |
|---|---|---|---|---|
| 4,426,087 | A * | 1/1984 | Sargent | F16J 15/441 277/422 |
| 7,726,940 | B2 * | 6/2010 | Snowsill | F16J 15/442 277/413 |
| 7,905,495 | B2 | 3/2011 | Munson | |
| 8,172,232 | B2 * | 5/2012 | Justak | F16J 15/442 277/411 |
| 8,740,225 | B2 | 6/2014 | Patterson et al. | |
| 2008/0217859 | A1 | 9/2008 | Addis | |
| 2011/0133410 | A1 | 6/2011 | Patterson et al. | |
| 2012/0171045 | A1 * | 7/2012 | Spangler | B05B 15/0456 416/241 R |

FOREIGN PATENT DOCUMENTS

| | | |
|---|---|---|
| WO | 2013191718 | 12/2013 |
| WO | 2014120116 | 8/2014 |

* cited by examiner

*Primary Examiner* — Nathan Cumar
(74) *Attorney, Agent, or Firm* — Carlson, Gaskey Olds, P.C.

(57) ABSTRACT

A seal assembly for a gas turbine engine includes a primary seal that includes an inner face that has a protrusion configured to seal relative to a seal land. The protrusion provided on segmented shoes is circumferentially spaced from one another by gaps. The shoes are positioned in a relaxed state. A removable material encases the protrusion with the shoes in the relaxed state.

20 Claims, 4 Drawing Sheets

GAS TURBINE ENGINE SEAL INSTALLATION PROTECTION

STATEMENT REGARDING FEDERALLY SPONSORED RESEARCH OR DEVELOPMENT

This invention was made with government support under Contract No. FA8650-09-D2923-0021 awarded by the United States Air Force. The Government has certain rights in this invention.

BACKGROUND

This disclosure relates to a temporarily protected seal for use in a gas turbine engine during insulation of the seal. The disclosure also relates to a method of protecting the seal prior to installation.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Seals are used in numerous locations within a gas turbine engine between static and rotating structure. The seals may include fragile features that are susceptible to damage during installation of the rotating structure relative to the static structure during engine assembly. One method has been proposed to protect the seal by first expanding the seal, which includes movable segments circumferentially separated by gaps. These gaps are enlarged and then a material, such as wax, is inserted into the enlarged gaps to hold the segments apart from one another providing a seal with an expanded diameter. However, fragile features, if present on an inner diameter of such a seal, may still be exposed and susceptible to damage despite the expanded diameter of the seal.

SUMMARY

In one exemplary embodiment, a seal assembly for a gas turbine engine includes a primary seal that includes an inner face that has a protrusion configured to seal relative to a seal land. The protrusion provided on segmented shoes is circumferentially spaced from one another by gaps. The shoes are positioned in a relaxed state. A removable material encases the protrusion with the shoes in the relaxed state.

In a further embodiment of the above, the inner face includes multiple axially spaced protrusions. The removable material encases the protrusions.

In a further embodiment of any of the above, the removable material is one of a plastic or a wax.

In a further embodiment of any of the above, the gaps are free from the removable material.

In a further embodiment of any of the above, a carrier supports the primary seal. The primary seal is arranged axially between a secondary seal and a plate.

In a further embodiment of any of the above, the primary seal includes an outer structure. A slot radially separates outer and inner beams from one another. A first cut radially separates the outer structure and outer beam. A second cut radially separates the inner beam and the shoes.

In a further embodiment of any of the above, the first and second cuts are joined at the gap. Adjacent hooks provide lateral faces that provide the gap.

In another exemplary embodiment, a method of manufacturing a seal assembly comprising the steps of providing a seal that has circumferentially segmented shoes separated by gaps. Protrusions are provided on an inner face of the seal and encase the protrusions with a removable material with the shoes positioned in a relaxed state.

In a further embodiment of any of the above, the method includes the step of masking the seal to prevent the removable material from penetrating the gaps prior to the encasing step.

In a further embodiment of any of the above, the method includes the step of removing the removable material from the gaps subsequent to the encasing step and prior to a seal installation step.

In a further embodiment of any of the above, the removable material is one of a plastic or a wax.

In a further embodiment of any of the above, the seal includes a carrier that supports a primary seal. The primary seal is arranged axially between a secondary seal and a plate. The primary seal provides the shoes.

In a further embodiment of any of the above, the primary seal includes an outer structure and a slot that radially separates outer and inner beams from one another. A first cut radially separates the outer structure and outer beam. A second cut radially separates the inner beam and the shoes.

In a further embodiment of any of the above, the first and second cuts are joined at the gap. Adjacent hooks provide lateral faces that provide the gap.

In another exemplary embodiment, a gas turbine engine seal arrangement includes a fixed structure and a rotatable structure that has a seal land configured to rotate relative to the fixed structure. A seal assembly includes a primary seal that includes an inner face that has a protrusion configured to seal relative to a seal land. The protrusion is provided on segmented shoes circumferentially spaced from one another by gaps. The shoes are positioned in a relaxed state. A removable material encases the protrusion with the shoes in the relaxed state. The removable material is adjacent to the seal land.

In a further embodiment of any of the above, the inner face includes multiple axially spaced protrusions. The removable material encases the protrusions.

In a further embodiment of any of the above, the removable material is one of a plastic or a wax.

In a further embodiment of any of the above, the gaps are free from the removable material.

In a further embodiment of any of the above, a carrier supports the primary seal. The primary seal is arranged axially between a secondary seal and a plate.

In a further embodiment of any of the above, the primary seal includes an outer structure. A slot radially separates outer and inner beams from one another. A first cut radially separates the outer structure and outer beam. A second cut radially separates the inner beam and the shoes. The first and second cuts are joined at the gap. Adjacent hooks provide lateral faces that provide the gap.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
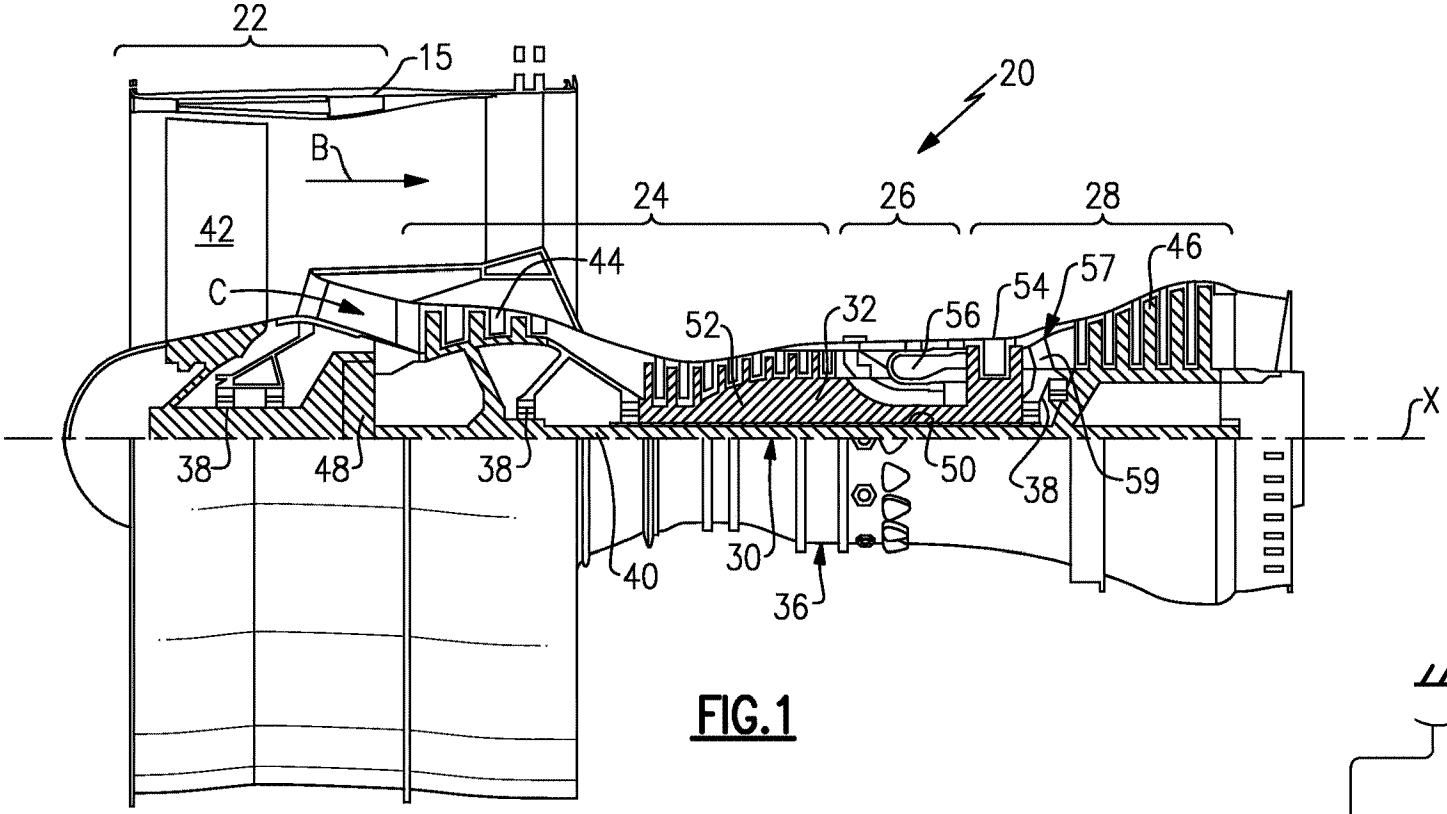
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
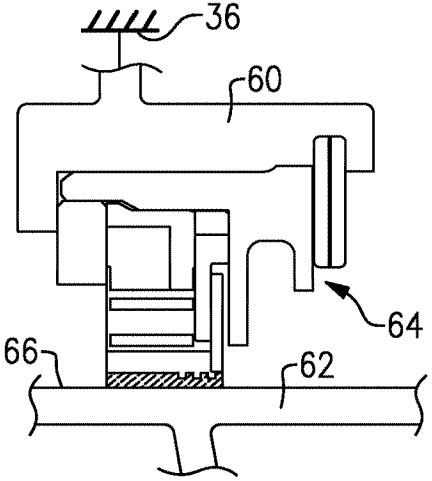
FIG. 2 is an enlarged schematic view of a seal assembly arranged between fixed and rotating structures.

An example seal assembly 64 is arranged between fixed and rotating structures 60, 62, as schematically illustrated in FIG. 2. The seal assembly 64 cooperates with a seal land 66 of the rotating structure 62 to prevent, for example, pressurized air from leaking past the seal assembly 64.

Figure 3:
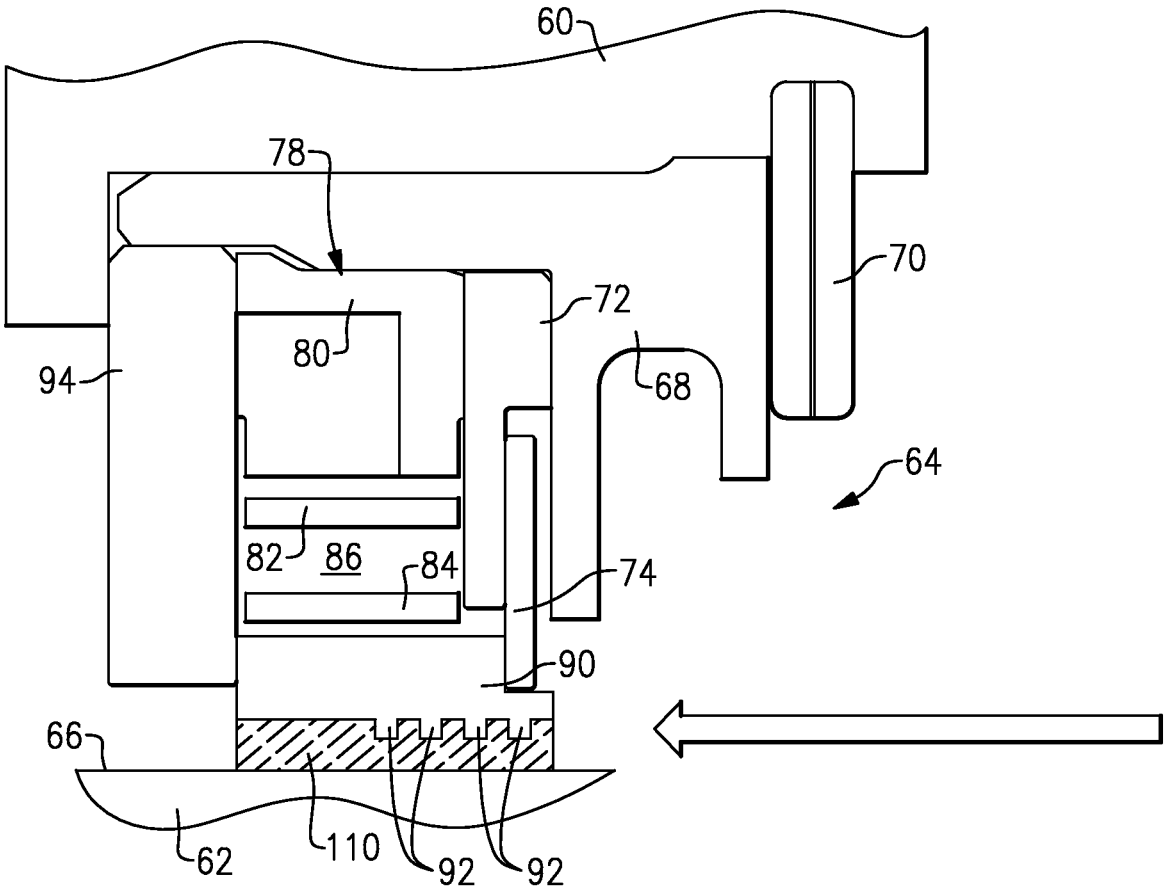
FIG. 3 is an enlarged cross-sectional view of one seal assembly embodiment.

An example seal assembly 64 is illustrated in more detail in FIG. 3. It should be understood, however, that the illustrated seal assembly 64 is exemplary only. It may include additional, different or fewer components or different structural features than illustrated. The seal assembly 64 includes a carrier 68 with which other seal components are mounted. The carrier 68 is axially retained relative to the fixed structure 60 with a retainer 70. A primary seal 78 is axially arranged between a spacer 72 and a plate 94. The spacer 72 is rotationally fixed with respect to the carrier 68. Secondary seals 74 are supported on the spacer 72 and fixed against rotation.

Figure 4:
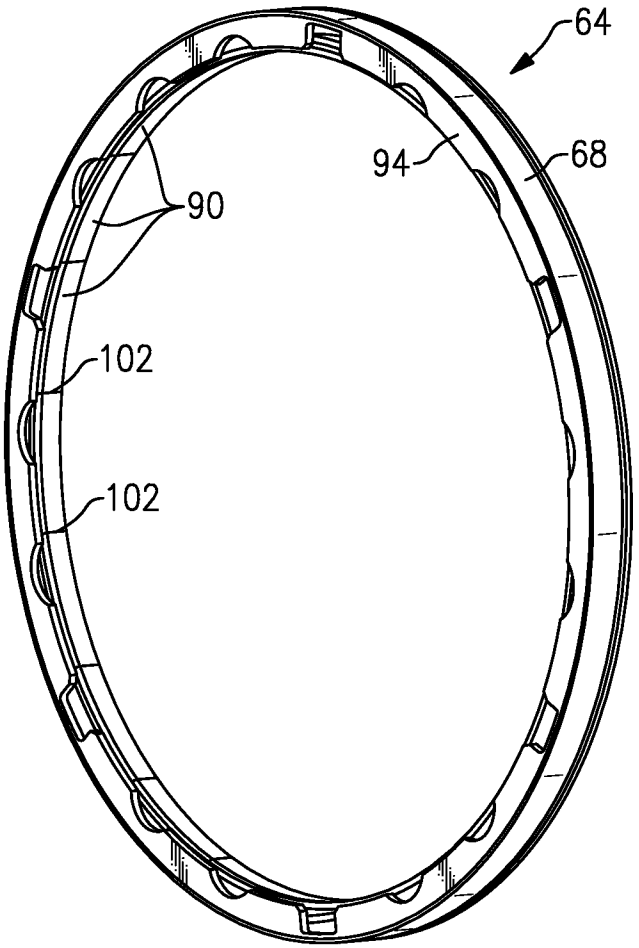
FIG. 4 is a perspective view of the seal assembly shown in FIG. 3.
Figure 6:
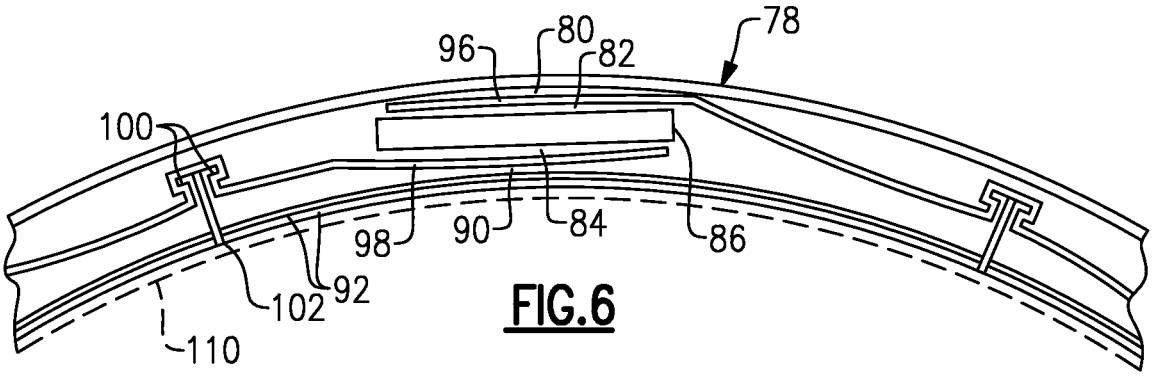
FIG. 6 is a plan view of a portion of a primary seal of the seal assembly illustrating various gaps and voids.

The primary seal 78 includes an outer structure 80, outer and inner beams 82, 84 and shoes 90 that are separated by spaces or voids to permit movement relative to one another and yet provide a single unitary structure, which is best appreciated with reference to FIG. 6. These clearances enable the circumferential arrangement of segmented shoes 90, as shown in FIG. 4, to float with respect to the seal land 66 during engine operation providing essentially a non-contact seal with respect to the seal land 66.

Figure 5A:
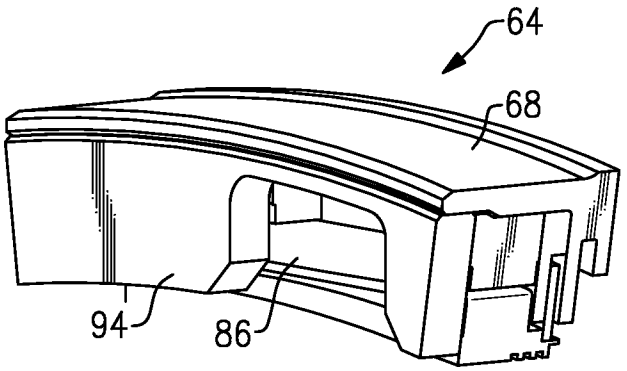
FIG. 5A is an enlarged partial cross-sectional view of the seal assembly shown in FIG. 4 with a plate installed.
Figure 5B:
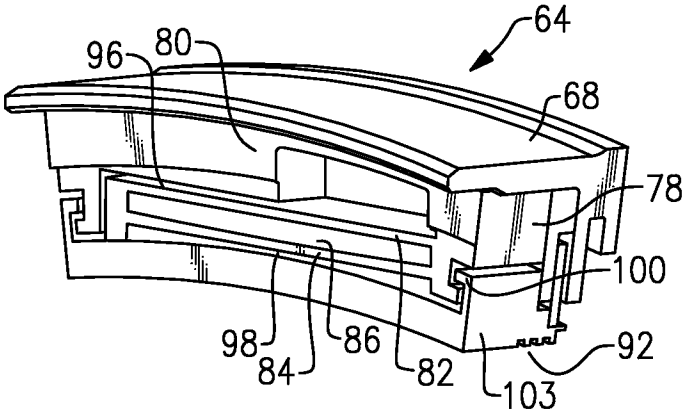
FIG. 5B is a partial cross-sectional view similar to 5A but with the plate removed.

In the example, an enlarged slot 86 radially separates the outer and inner beams 82 from one another, as shown in FIGS. 5A and 5B. Referring to FIG. 6, a first cut 96 radially separates the outer structure 80 and outer beam 82, while a second cut 98 radially separates the inner beam 84 and shoes 90. Hooks 100 limit the radial movement of the shoes 90 with respect to the outer structure 80.

Typically, multiple shoes are circumferentially spaced apart from one another and separated by a circumferential gap 102 at adjoining lateral faces 103 of the shoes 90. The first and second cuts 96, 98 are joined at the gap 102. The circumferential gaps 102 enable the shoes 90 to move independently from one another radially inwardly and outwardly during engine operation.

Referring to FIG. 2, an inner face of the shoes 90 include axially spaced circumferential protrusions 92 that provide an axially undulating surface, which creates a tortuous flow path to prevent air from flowing past the seal assembly 64. These protrusions 92 are relatively fragile and may become damaged when the rotating structure 62 is axially inserted into the fixed structure 60 during engine assembly. It is desirable to protect these protrusions during installation, for example, with a removable material 110, such as wax or plastic having a relatively low melting temperature or solubility in the presence of a solvent, or a material that sublimes may also be used. A segmented seal that has intricate slots and voids, such as the example seal assembly 64, may become undesirably impregnated with the material, which may inhibit the seal's function during engine operation. It is desirable to retain the movement of the shoes 90 during installation. Thus, it is desirable to have the seal assembly 64 in a relaxed, unexpanded state with the material 110 applied.

Masks may be used with the primary seal 78 to prevent the material 110 from penetrating the circumferential gaps 102 or other spaces of the primary seal 78 when applying the material 110 to protect the protrusions 92.

Figure 7A:
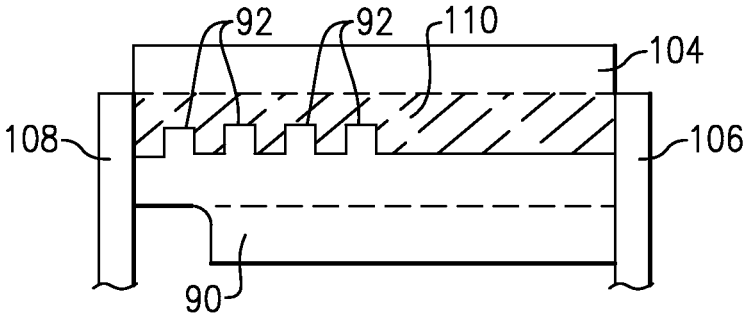
FIG. 7A is an enlarged view of a seal assembly shoe with masks in place to contain material in a desired area of the shoe.
Figure 7B:
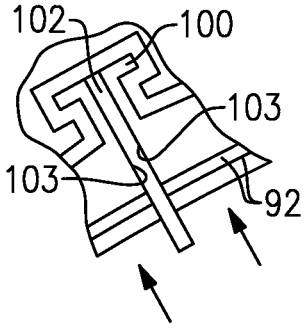
FIG. 7B is an end view depicting one of the masks shown in FIG. 7A arranged between a circumferential gap of adjacent shoes.

Referring to FIGS. 7A-7B, a circumferential mask 104 may be inserted into each gap 102 between the lateral faces 103. Forward and aft masks 106, 108 are arranged on either side of the shoe 90. The material 110 is then applied to the inner diameter face of the shoe 90 having the protrusions 92, which is arranged within the region defined by the mask 104-108. Once the material 110 has solidified, the masks 104-108 can be removed. The primary seal 78 need not be expanded during application of the material 110.

Alternatively, and without expanding the primary seal 78, the material may be applied to the inner face of the shoes 90 having the protrusions 92. If the material 110 penetrates any undesired areas, such as the circumferential gap 102 or other spaces, it may be selectively removed.

Using the above techniques, the seal assembly 64 can function as designed even with the material 110 applied. Once the protrusions 92 have been encapsulated or encased with the material 110, the rotating structure 62 may be axially slid into place past the fully assembled seal assembly 64. During installation, the seal land 66 may ride along an inner surface of the material 110, which expands the primary seal 78 since the seal assembly 64 is otherwise unobstructed by the material 110 in its circumferential gaps 102.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A seal assembly for a gas turbine engine comprising:

a primary seal that includes an inner face having a protrusion configured to seal relative to a seal land, the protrusion provided on segmented shoes circumferentially spaced from one another by gaps, the shoes positioned in a relaxed state; and a removable material encasing the protrusion with the shoes in the relaxed, unexpanded state.

2. The seal assembly according to claim 1, wherein the inner face includes multiple axially spaced protrusions, the removable material encasing the protrusions.

3. The seal assembly according to claim 2, wherein the removable material is one of a plastic or a wax.

4. The seal assembly according to claim 1, wherein the gaps are free from the removable material.

5. The seal assembly according to claim 1, comprising a carrier supporting the primary seal, the primary seal arranged axially between a secondary seal and a plate.

6. The seal assembly according to claim 1, wherein the primary seal includes an outer structure, a slot that radially separates outer and inner beams from one another, a first cut radially separates the outer structure and outer beam, and a second cut radially separates the inner beam and the shoes.

7. The seal assembly according to claim 6, wherein the first and second cuts are joined at the gap, adjacent hooks provide lateral faces that provide the gap.

8. A method of manufacturing a seal assembly comprising the steps of:

providing a seal having circumferentially segmented shoes separated by gaps, and protrusions provided on an inner face of the seal; and encasing the protrusions with a removable material with the shoes positioned in a relaxed unexpanded state.

9. The method according to claim 8, comprising the step masking the seal to prevent the removable material from penetrating the gaps prior to the encasing step.

10. The method according to claim 8, comprising the step of removing the removable material from the gaps subsequent to the encasing step and prior to a seal installation step.

11. The method according to claim 8, wherein the removable material is one of a plastic or a wax.

12. The method according to claim 8, wherein the seal includes a carrier supporting a primary seal, the primary seal arranged axially between a secondary seal and a plate, the primary seal provides the shoes.

13. The method according to claim 12, wherein the primary seal includes an outer structure, a slot that radially separates outer and inner beams from one another, a first cut radially separates the outer structure and outer beam, and a second cut radially separates the inner beam and the shoes.

14. The method according to claim 13, wherein the first and second cuts are joined at the gap, adjacent hooks provide lateral faces that provide the gap.

15. A gas turbine engine seal arrangement comprising:

a fixed structure;

a rotatable structure having a seal land configured to rotate relative to the fixed structure; and a seal assembly includes a primary seal that includes an inner face having a protrusion configured to seal relative to a seal land, the protrusion provided on segmented shoes circumferentially spaced from one another by gaps, the shoes positioned in a relaxed state; and a removable material encasing the protrusion with the shoes in the relaxed, unexpanded state, the removable material adjacent to the seal land.

16. The seal arrangement according to claim 15, wherein the inner face includes multiple axially spaced protrusions, the removable material encasing the protrusions.

17. The seal arrangement according to claim 16, wherein the removable material is one of a plastic or a wax.

18. The seal arrangement according to claim 15, wherein the gaps are free from the removable material.

19. The seal arrangement according to claim 15, comprising a carrier supporting the primary seal, the primary seal arranged axially between a secondary seal and a plate.

20. The seal arrangement according to claim 15, wherein the primary seal includes an outer structure, a slot that radially separates outer and inner beams from one another, a first cut radially separates the outer structure and outer beam, and a second cut radially separates the inner beam and the shoes, the first and second cuts are joined at the gap, adjacent hooks provide lateral faces that provide the gap.

* * * * *